US007645170B2

(12) United States Patent
Long et al.

(10) Patent No.: US 7,645,170 B2
(45) Date of Patent: Jan. 12, 2010

(54) AUDIO JACK HAVING DUSTPROOF FILM

(75) Inventors: Ji-En Long, ShenZhen (CN); Hai-Qiu Lu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/156,881

(22) Filed: Jun. 4, 2008

(65) Prior Publication Data

US 2008/0299837 A1 Dec. 4, 2008

(30) Foreign Application Priority Data

Jun. 4, 2007 (TW) ..... 96209155

(51) Int. Cl.
*H01R 24/04* (2006.01)

(52) U.S. Cl. ..... 439/668; 439/669; 439/910

(58) Field of Classification Search ..... 439/668, 439/669, 108, 910, 188
See application file for complete search history.

(56) References Cited

U.S. PATENT DOCUMENTS 4,837,598 A * 6/1989 Nonami ..... 399/98
5,450,174 A * 9/1995 Osbourne et al. ..... 399/186
6,224,408 B1 * 5/2001 Wu ..... 439/188

* cited by examiner

*Primary Examiner*—Tho D Ta
(74) *Attorney, Agent, or Firm*—Ming Chieh Chang; Wei Te Chung; Andrew C. Cheng

(57) ABSTRACT

An audio jack comprises a housing and a plurality of contacts received in the housing. The housing defines a receiving hole along the longitudinal direction of the housing, and the face of the housing has at least an opening communicating with the receiving hole. The contacts at least include a deflectable contact and a fixed contact. The audio jack includes at least a dustproof film covering said opening so as to prevent the dust invading the interior of the audio jack.

17 Claims, 3 Drawing Sheets

AUDIO JACK HAVING DUSTPROOF FILM

BACKGROUND OF THE INVENTION

1. Field of the Invention

The present invention generally relates to an electrical connector, and particularly to an audio jack having dustproof film, wherein the audio jack can achieve a good electrical connection with a mating plug for a long time.

2. Description of the Prior Art

Due to the development of the information and communication technology industry, various types of portable wireless terminals are beginning to crop up such as mobile phones, Personal Digital Assistant always simply called as PDA and so forth. Mobile phone or PDA is required to provide connectors at input/output ports, which are usually mounted on a main printed circuit board (PCB) thereof, to mate with corresponding complementary plug for signal transmission therebetween. With the development of portable wireless terminals, audio jack connectors are used in these portable wireless terminals more and more.

An existing audio jack connector includes an insulative housing and a plurality of contacts assembled to the insulative housing. The insulative housing defines a mating hole along the longitudinal direction of the housing. The contacts at least include a fixed contact and a deflectable contact positioned to be connected to and disconnected from the fixed contact. The face of the insulative housing has a plurality of openings communicating with the mating hole for mounting the contacts and observing the contact state of the deflectable contact and the fixed contact. But when the audio jack connector in a dusty space, the dust invades the interior of the audio jack connector will led to a bad electrical connection with a mating plug connector.

Hence, it is desired to have an audio jack connector solving the problem above.

BRIEF SUMMARY OF THE INVENTION

Accordingly, an object of the present invention is to provide an audio jack having dustproof film for prevent the dust invading the interior of the audio jack.

In order to attain the objective above, an audio jack mounted on a PCB, comprises an insulative housing and a plurality of contacts retained in the insualtive housing. The insulative housing defines a base extending along a longitudinal direction having a mating face at a front end thereof, a mounting face facing to the PCB and a bodying face. A cylindrical portion protrudes forwardly from the mating face, and the cylindrical portion defines a receiving hole extending into the base for receiving a corresponding complementary plug. At least an opening defined in the bodying face and in communication with the receiving hole, and at least a dustproof film covering said opening of the insulative housing so as to prevent the dust invading the bowel of the audio jack.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 2:
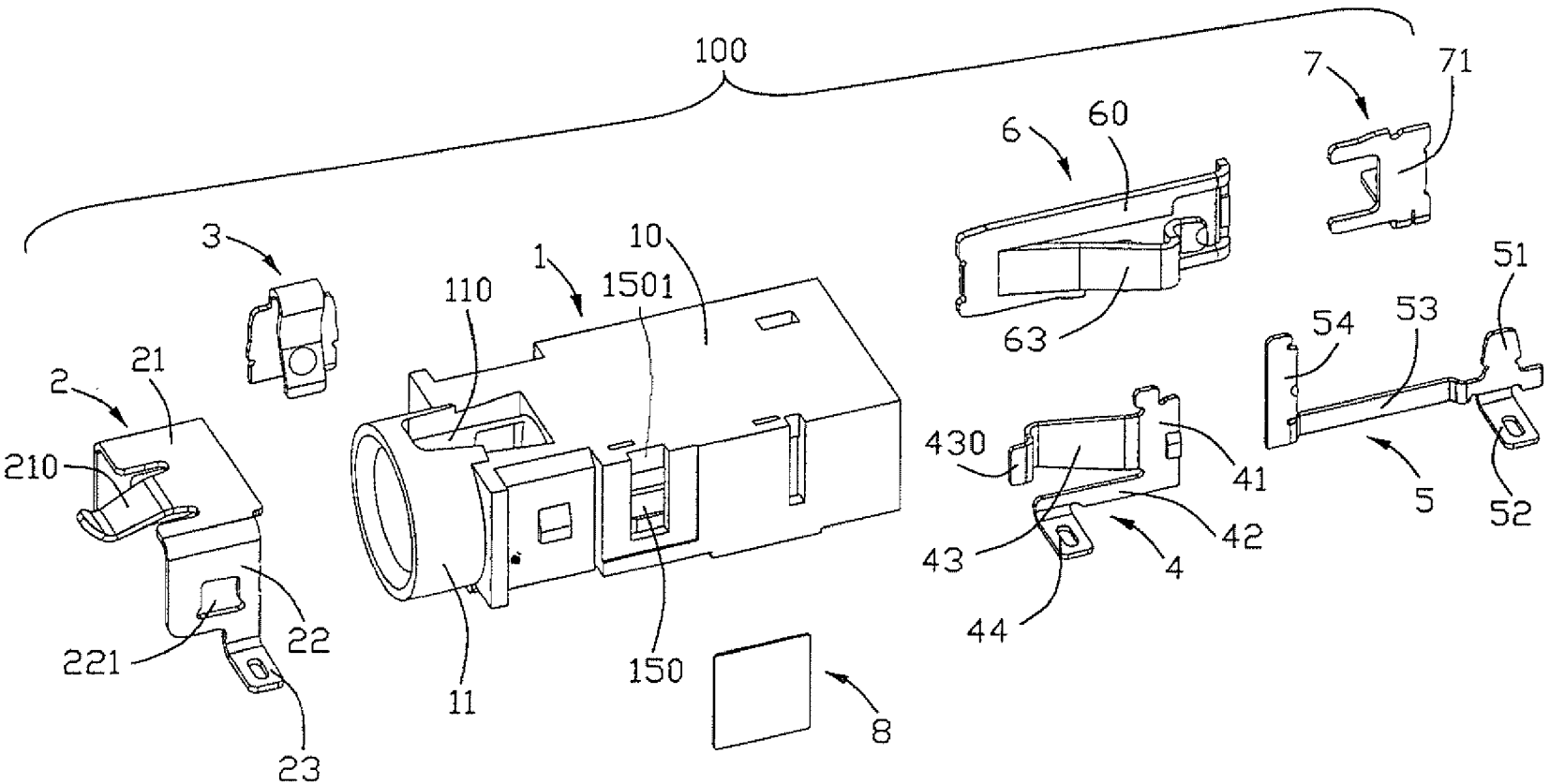
FIG. 2 is an exploded, perspective view of the audio jack as shown in FIG. 1.
Figure 3:
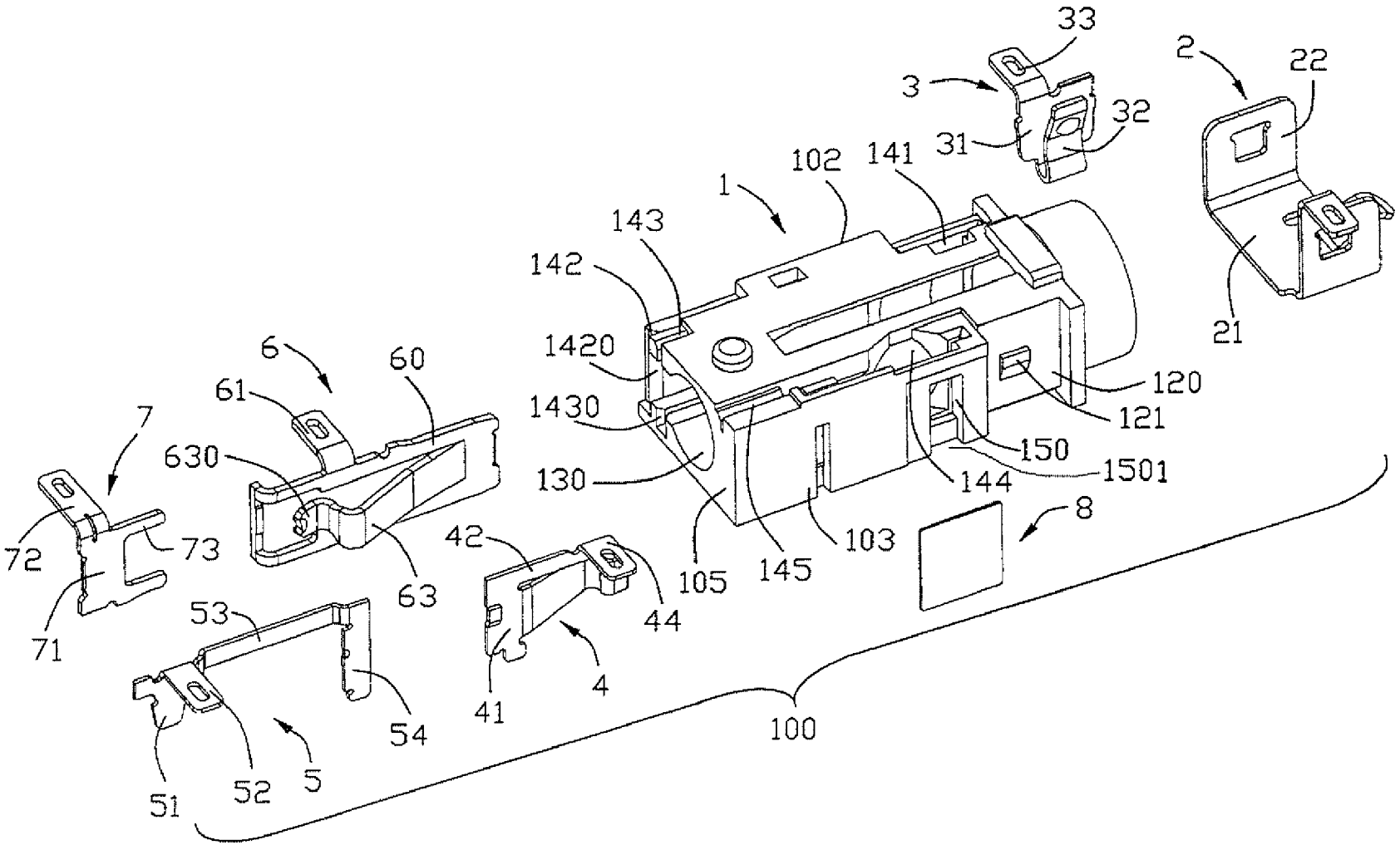
FIG. 3 is another exploded, perspective view of the audio jack as show in FIG. 1.

Referring to FIGS. 2 and 3, an audio jack 100 is mounted on the printed circuit board (PCB) (not shown) for electrically connecting a mating plug (not shown), according to the present invention comprises an insulative housing 1, a plurality of contacts 2, 3, 4, 5, 6, 7 and at least a dustproof film 8.

The insulative housing 1 includes a substantially cubical base 10 extending along a longitudinal direction having upper face 101, left-side face 102, right-side face 103, mounting face 104 opposite to the upper face 101, rear face 105 and mating face 106 opposite to the rear face 105. The upper face 101, left-side face 102, right-side face 103 and the rear face 105 form a bodying face. A cylindrical portion 11 protrudes forwardly from the mating face 106 of the base 10, and a receiving hole 12 is longitudinally defined through the cylindrical portion 11 and the base 10 for receiving the mating plug. A first opening 110 adjacent to the cylindrical portion 11 is defined in the upper face 101, the first opening 110 run through the upper face 101 and in communicate with the receiving hole 12. Two recesses 120 are formed at the left-side face 102 and the right-side face 103 respectively, and a projection 121 protrudes upwardly in the recess 120. In addition, the rear face 105 defines a second opening 130 made by the receiving hole 12.

Referring to FIG. 3, the mounting face 104 forms a first groove 141 communicating with the first opening 110, a second groove 142 and a third groove 143 adjacent to a corner of the left-side face 102, a fourth groove 144 and a fifth groove 145 adjacent to a edge of the right-side face 103. In addition, the rear face 105 further defines a third opening 1420 made by the second groove 142 and a fourth opening 1430 made by the third groove 143.

Figure 1:
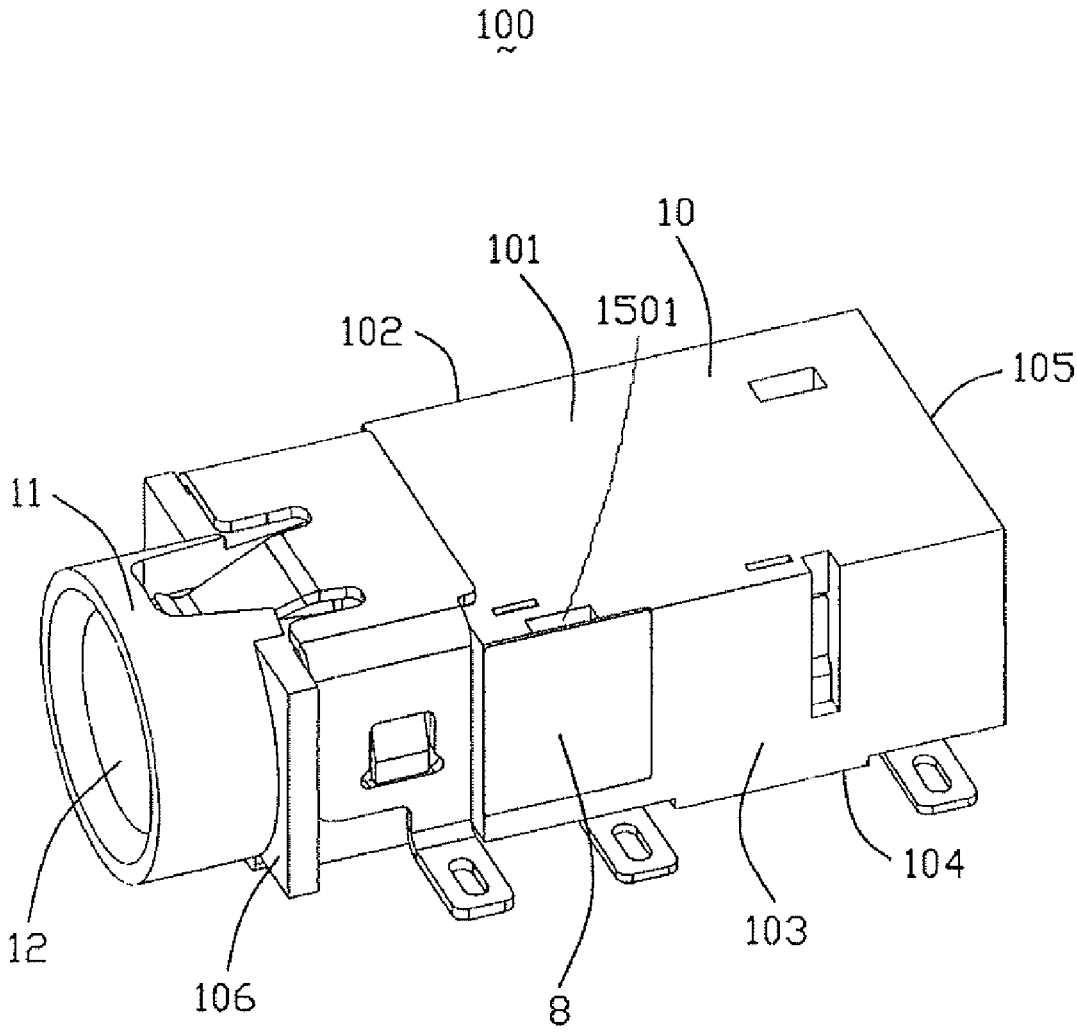
FIG. 1 is an assembled, perspective view of an audio jack according to a preferred embodiment of the present invention.

Referring to FIG. 1 to FIG. 3, the right-side face 103 defines a fifth opening 150, also called observation window 150, adjacent to the recess 120 and in communication with the receiving hole 12. The fifth opening 150 extends through the upper face 101, forming a recess 1501 in the upper face 101.

The plurality of contacts comprises a first signal contact 2, a second signal contact 3, a first deflectable contact 4, a first fixed contact 5, a second deflectable contact 6 and a second fixed contact 7.

The first signal contact 2 has a first securing portion 21 thereof incorporated at both ends with leg portions 22, bent away therefrom thus forming a U shape. The leg portions 22 have engaging openings 221 arranged in the center thereof respectively and a rectangular first solder tab 23 extending perpendicularly from the bottom end of the leg portion 22 for being face mounted on the printed circuit board. In addition, a first resilient portion 210 extends downwardly at an angle from the top end of the first securing portion 21.

The second signal contact 3 has a second securing portion 31, a second resilient portion 32 extending downwardly at an angle from the top end of the first securing portion 31 and a rectangular second solder tab 33 extending perpendicularly from the bottom end of the second securing portion 31 for being face mounted on the printed circuit board.

The first deflectable contact 4 defines a third securing portion 41, a third resilient portion 43 extending from the middle side of the third securing portion 41, and a arm 42 extending from the end of the third securing portion 41 and below the third resilient portion 43. In addition, a first contact tongue 430 extends at free end of the resilient portion 43 and a rectangular third solder tab 44 extends perpendicularly from the bottom end of the arm 42 for being face mounted on the printed circuit board.

The first fixed contact 5 has a inserted portion 51, a rectangular fourth solder tab 52 extending perpendicularly from the inserted portion 51 for being face mounted on the PCB, a link portion 53 extending from the side of the inserted portion 51, and a contact portion 54 protruding horizontally from the side of the inserted portion 51.

The second deflectable contact 6 and the second fixed contact 7, wherein the second deflectable contact 6 and the second fixed contact 7 are inserted successively to the rear face 105 of the insulative housing 1.

The second deflectable contact 6 defines a four-sided metal seat plate 60 having a fourth resilient portion 63 between its sides. The rectangular seat plate 60 is arranged for mounting in a vertical arrangement and has an outwardly bent fifth tab 61 formed in the rear lower end thereof. The fourth resilient portion 63 of the seat plate 60 extends from the front end of the same towards the rear end while also extending inwardly. The fourth resilient portion 63 is formed by cutting out and lifting up a segment of the center region of the seat plate 60. In addition, a second contact tongue 630 extends at free end of the resilient portion 63.

The second fixed contact 7 defines a fourth securing portion 71, a rectangular sixth solder tab 72 extending perpendicularly from the bottom end of the fourth securing portion 71 for being face mounted on the printed circuit board, and two strips 73 extending from the opposite end of the securing portion 71 respectively.

The dustproof film 8 is made of temperature resistant material and is thus adapted to bear a high temperature caused by a soldering process for mounting the audio jack 100 to the PCB. And in this present invention, the dustproof film 8 having a first face having an adhesive coating for releasably attaching the film 8 to the audio jack 100 to shield the openings 110, 130, 1420, 1430, 150 which defined in the bodying face and in communicating with the receiving hole 12. For example with the fifth opening 150, the first deflectable contact 4 contactable with the first fixed contact 5 and the third resilient portion 43 extending into the receiving hole 12 for abutting against the mating plug, said first deflectable contact 4 being deflectable when the mating plug is inserted and drives the third resilient portion 43 to move outwardly with the first contact tongue 430 disengaging from the first fixed contact 5, the housing 1 defining the fifth opening 150 for observing the state of electrical connection between the switching contacts 4, 5. The dustproof film 8 covers said fifth opening 150 of the insulative housing 1 so as to prevent the dust invading the bowel of the audio jack 100, of cause, in this example, the dustproof film 8 is made of pellucudness material simultaneously so as to observe the state of electrical connection between the switching contacts 4, 5.

In assembly, with reference to FIGS. 1, 2 and 3, the first signal contact 2 is retained in the upper face 101 by engagement of the projection 121, The first resilient portion 210 projects inwardly from the first opening 110 of the upper face 101 into the receiving hole 12. The second signal contact 3 is received in the first groove 141 and the second resilient portion 32 extending into the receiving hole 12. The first deflectable contact 4 is retained in the fourth groove 144 and the third resilient portion 43 projects inwardly into the receiving hole 12. The first fixed contact 5 is retained in the fifth groove 145 of the insulative housing 1. Than, the second deflectable contact 6 and the second fixed contact 7 are inserted successively to the rear face 105 of the insulative housing 1. At the last, for actual need, the dustproof film 8 covers the opening which in communicating with the receiving hole 12, or the bodying face of the housing 1 is fully covered by the dustproof film 8, or just the right-side face 103 covered by the dustproof film 8 and so on.

In the present invention, due to the audio jack 100 having the dustproof film 8. The audio jack 100 has a good electrical connection with the mating plug because of the dustproof film 8 prevent the dust invading the bowel of the audio jack 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The novel features of the invention are set forth with particularity in the appended claims. The invention will be best understood from the following description when read in conjunction with the accompanying drawings.

What is claimed is:

1. An audio jack for electrically connecting a mating plug, comprising:

an insulative housing comprising a base extending along a longitudinal direction and a cylindrical portion protruding forwardly from a front face of the base, the cylindrical portion defining a receiving hole extending into the base for receiving the mating plug;

a plurality of contacts retained in the base, comprising at least a pair of switching contacts having a deflectable contact and an fixed contact, the deflectable contact defining a contact tongue contactable with the fixed contact and a resilient portion extending into the receiving hole for abutting against the mating plug, said deflectable contact being deflectable when the mating plug is inserted and drives said resilient portion to move outwardly with the contact tongue disengaging from the fixed contact, the housing on a side face thereof defining an observation window from which to observe the state of electrical connection between the switching contacts; and a dustproof film covering said observation window to prevent the dust from invading the interior of the audio jack but having no influence to the observation by said observation window;

wherein file base has a mating face, a left-side face, a right-side face, a mounting face, an upper face opposite to the mounting face and a rear face opposite to the mating face; the left-side face, the right-side face, the upper face and the rear face forming a bodying face.

2. The audio jack according to claim 1 wherein one face of the bodying face is fully covered by the dustproof film.

3. The audio jack according to claim 1, wherein the dustproof film is made of pellucidness material.

4. The audio jack according to claim 3, wherein the dustproof film has an adhesive coating thereon for releasably attaching the film to the audio jack to shield the opening.

5. The audio jack according to claim 1, wherein the audio jack is mounted on a printed circuit board, and the contacts have a plurality of solder tabs extending beyond the mounting face to be face mounted on the printed circuit board.

6. The audio jack according to claim 5, wherein said observation window extends through an upper face of the housing and upwardly communicates with an exterior.

7. An audio jack is mounted on a printed circuit board (PCB) for mating with a plug, comprises:

an insulative housing defining a base extending along a longitudinal direction having a mating face at a front end thereof, a mounting face facing to the PCB and a bodying face, a cylindrical portion protruding forwardly from the mating face, and the cylindrical portion defining a receiving hole extending into the base for receiving the plug, the bodying face defining an opening in communication with the receiving hole;

a plurality of contacts retained in the base having a plurality of solder tabs extending beyond the mounting face to be face mounted on the PCB; and wherein the opening is defined for observing the state of electrical connection between the contacts;

wherein a dustproof film covering said opening to prevent the dust from invading the interior of the audio jack but having no influence to the observation by said opening.

8. The audio jack according to claim 7, wherein the base of the insulative housing is in shape of a substantially rectangular block, and the bodying face comprising upper, left-side, right-side and rear faces.

9. The audio jack according to claim 7, wherein the bodying face is fully provided with the dustproof film.

10. The audio jack according to claim 7, wherein said opening extends through an upper face of the housing and upwardly communicates with an exterior.

11. The audio jack according to claim 7, wherein the dustproof film is made of temperature resistant material and is thus adapted to bear a high temperature caused by a soldering process for mounting the audio jack to the PCB.

12. The audio jack according to claim 11, wherein the dust-proof film has an adhesive coating for releasably attaching the film to the audio jack to shield the opening.

13. An audio jack comprising:

an insulative housing defining therein a plug receiving space in an axial direction, and thereon a first face facing toward an exterior in a first direction, and thereon a second face facing toward the exterior in a second direction perpendicular to said first direction;

a passageway extending from the first face, proximal to an edge thereof, into the housing in a third direction opposite to said first direction;

a contact inserted into the passageway in said third direction and including a deflectable arm with a contact section extending into the plug receiving space; and a cutout extending from the second face, proximal to said edge, into the housing in said fourth direction opposite to the second direction, and essentially communicating with said passageway in said second direction; wherein said cutout is covered by a film from said exterior in said second direction for anti-dust;

wherein the second face is essentially on a lateral side of the housing;

wherein said first face is essentially on a bottom side of the housing which is eventually mounted upon a printed Circuit board on which contacts of the connector is soldered, and said first direction is perpendicular to both said axial direction and said second direction.

14. The audio jack as claimed in claim 13, wherein said film is either translucent or transparent for observing, through said cutout, a connection state of said contact in said housing.

15. The audio jack as claimed in claim 13, wherein said cutout extends through a third face of the housing which is adjacent to and perpendicular to said second face and different from the first face, so that said cut-out is communicative with the exterior.

16. The audio jack as claimed in claim 15, wherein said third face is essentially on an upper side of the housing so as to allow said cutout to upwardly communicate with the exterior.

17. The audio jack as claimed in claim 16, wherein said first face is essentially on a bottom side of the housing which is eventually mounted upon a printed circuit board on which contacts of the connector is soldered.

* * * * *